313-414 SR
10/8/85 OR 4,546,287

United States Patent [19]

Collins et al.

[11] Patent Number: 4,546,287

[45] Date of Patent: Oct. 8, 1985

[54] CATHODE RAY TUBE FOCUSING ELECTRODE SHIELDING MEANS

[75] Inventors: Floyd K. Collins, Seneca Falls; Frederick A. Hovey, Geneva; Loren L. Maninger, Marcellus, all of N.Y.

[73] Assignee: North American Philips Consumer Electronics Corp., New York, N.Y.

[21] Appl. No.: 424,117

[22] Filed: Sep. 27, 1982

[51] Int. Cl.[4] ..... H01J 29/58

[52] U.S. Cl. ..... 313/414; 313/409

[58] Field of Search ..... 313/414, 412, 409, 417, 313/441, 442, 443, 432, 433, 436, 439, 437

[56] References Cited

U.S. PATENT DOCUMENTS 4,310,780 1/1982 Sakurai et al. ..... 313/414 X
4,362,964 12/1982 Sakurai et al. ..... 313/414
4,370,593 1/1983 Sweigart et al. ..... 313/409 X
4,439,710 3/1984 Osakabe et al. ..... 313/414

*Primary Examiner*—David K. Moore
*Assistant Examiner*—K. Wieder
*Attorney, Agent, or Firm*—John C. Fox

[57] ABSTRACT

The invention relates to incorporating improved beam shielding means into the unitized focusing electrode structure of a plural beam in-line color cathode ray tube electron gun assembly. At least a portion of the G3 electrode structure is fabricated of a magnetic alloy material. Positioned forward and adjacent to the magnetic portion is an apertured planar shielding means also fabricated of magnetic material. The cooperation of these adjoining magnetic areas provides significant shielding of the beams from the deleterious back-field of the deflection yoke.

17 Claims, 11 Drawing Figures

CATHODE RAY TUBE FOCUSING ELECTRODE SHIELDING MEANS

BACKGROUND OF THE INVENTION

1. Field Of The Invention

This invention relates to the in-line electron gun assembly of a plural beam color cathode ray tube, and more particularly to the focusing electrode structure thereof wherein magnetic beam shielding means are utilized.

2. Prior Art

Present day color cathode ray tubes (CRTs) commonly utilized in television and allied display applications often employ plural beam in-line electron gun assemblies wherein three separate electron beams emanate in a substantially common horizontal plane. In keeping with the present state of the art, the separate guns are compacted into a unitized assembly, from which the beams are designed to converge at the plane of a multi-opening shadow mask, and pass through the mask openings to impinge upon and excite the discrete red, green and blue color emitting elements of a phosphor array disposed on the interior surface of the tube viewing panel.

In the plural beam in-line gun assembly, the electrons emitted from separate cathodes are formed into beams, focused, accelerated and directed toward the viewing screen by a sequential arrangement of related electrodes. The design of the various electrode members of the unitized gun structure has evolved over the years into a highly sophisticated art. The size, shape, relative spacing, and materials used in the fabrication of these electrodes are influenced by a variety of considerations, the most important of which is the achievement of desired red, green and blue registration in the screen.

During tube operation, scanning of the three beams across the screen to form the red, green and blue definitive raster patterns is achieved with a deflection yoke externally positioned to encompass the neck and funnel portions of the tube envelope in the vicinity of the forward portion of the gun assembly, in conjunction with associated control circuitry. Such a combination produces varying magnetic fields within the tube which effect sequential horizontal sweeping of the beams exiting the gun to form the respective red, blue and green raster patterns. Technological advancement has produced simplified dynamic convergence circuitry for use with a self-converging yoke embodying pin cushion correction. This yoke, developed for use on in-line tubes, conventionally employs saddle horizontal deflection windings and toroidal vertical deflection windings, and as such, effects a reduction in yoke weight and material utilized. But, raster sizes are sometimes adversely affected by the introduction of aberations into the system. To the extent possible, corrections for such raster size deviations are attempted in the design parameters of the electron gun components.

There is an ever increasing trend for the manufacturer of display equipment to demand higher performance without incurring an associated increased cost penalty for cathode ray tubes. Such demands have led to increasingly sophisticated electron gun designs along with tighter tolerances on all parts of the CRT including the respective positions of the electron gun assembly and the associated external deflection yoke. Because of such high performance standards and the difficulty encountered in achieving them, for example, raster convergence, various tolerances in the tube which previously were considered acceptable have now become unacceptable. For example, in achieving raster convergence, it has been discovered that the relative positions of the in-line electron gun assembly in the neck of the tube and the externally oriented deflection yoke are extremely critical in achieving the required raster convergence demanded by the customer.

While modern unitized in-line color guns may contain as many as six or more electrodes, a commonly utilized type is the bi-potential gun wherein beam focusing is determined by the ratio of the focus electrode voltage to the respective accelerating electrode or anode voltage. A bi-potential in-line gun assembly of this type conventionally consists of a first plural-apertured planar G1 electrode positioned forward of three separate in-line cathodes; a second plural-apertured planar G2 electrode spaced forward of the G1 electrode; a third box-like electrode G3, commonly referred to as the focusing electrode, positioned forward of the G2 electrode; and a fourth or final cup-shaped G4 electrode which is often referred to as the accelerating electrode. Attached to the top of the G4 electrode is a convergence cup often containing soft magnetic materials known as shunts and/or enhancers for beneficially modifying the deflection fields of the yoke on the two outer electron beams.

The focusing G3 electrode is often formed by positioning two cup-shaped members in abutting relationship with the open tops there of facing each other to form an enclosure. Three in-line apertures are formed in the bottom of each cup-shaped member to permit passage of the respective electron beams therethrough. The longitudinal spacing between these two apertured surfaces is an important factor in the design of the electron gun structure. Various means have been used to achieve the desired spacing. For example, G3 electrodes have been formed by placing two such apertured enclosures in abutting relationship to maintain alignment of the apertures. In addition, apertured spacers have been employed between or within such enclosures in order to further adjust the overall length of the G3 electrode. While an integrated structure of this type may evidence a separate aperture plane intermediate the forward and rear aperture planes, such intermediate plane has little or no focusing effect upon the electron beams passing therethrough.

Slight adjustments of the yokes on the necks of in-line tubes have been found to be very critical for achieving desired resolution and convergence, especially in the 6 and 12 o'clock regions, of the raster.

Sometimes magnetic material has been employed in the rear portion of the G3 electrode to provide a degree of beam shielding from the toroidal yoke, which sometimes forms backfields extending into at least the G3–G4 vicinity of the gun assembly.

Accordingly, there is felt to be a continuing need to improve electron gun structures not only to satisfy increasing demands for improved performance of the cathode ray tube, but also to relieve tolerance limitations on other aspects of tube design and manufacture and, therefore, to achieve such improved performance at little or no cost penalty.

SUMMARY OF THE INVENTION

In accordance with the invention, it has been discovered that increasing the amount of magnetic material present in the G3 focusing electrode of a color CRT unitized in-line electron gun assembly beyond that used in the prior art, significantly reduces the sensitivity of relative positions of the gun and yoke. Thus, desirable dynamic convergence of the red, green and blue rasters is more easily achieved. More particularly, it has been discovered that use of magnetic material in the G3 focusing electrode, in a manner to be specified herein, achieves significant shielding of the beams from the extensive yoke backfield, thereby enabling greater relative movement of the gun structure and yoke without substantially interfering with desired raster convergence.

Accordingly, in the broad aspect of the invention, a G3 focusing electrode structure is formed of an integration of a plurality of cup-shaped components, each having an open portion and an opposing substantially planar closed portion with a plurality of in-line apertures therethrough and oriented transverse to the beam paths. At least two of these components are positioned with their open portions in abutted relationship to form a box-like enclosure. At least one in-line apertured planar shielding means, formed of magnetic material, is oriented transverse to the beam paths and forward of the rearmost aperture plane to provide improved shielding of the yoke backfield. In addition, at least one of the cup-shaped components may also be of a magnetic material to effect an additional degree of beam shielding from the backfield of the yoke.

In one embodiment of the invention, the G3 electrode structure is comprised of forward and rear adjoining enclosed sections formed of sequentially oriented first, second, third and fourth cup-shaped components, whereof the first component is fabricated of a magnetic material. The rear section is formed of the first and second components having their open ends in abutting relationship, while the forward section is formed of the third and fourth components in a similar abutting relationship. An apertured magnetic planar shielding means is positioned between the first and second components of the rear enclosure.

In another embodiment, wherein more shielding is provided, the electrode structure is likewise comprised of the forward and rear enclosed sections formed of the four cup-shaped components as described above. In this embodiment, the first and second components of the rear enclosure are both formed of magnetic material, and the forward aperture plane of the second component provides the forwardly oriented apertured magnetic shielding plane for the structure. If a greater mass of shielding material is required, a separate apertured planar member of magnetic material may be positioned between the second and third components.

In another embodiment of the invention, the G3 electrode likewise has forward and rear adjoining enclosed sections comprised of the four cup-shaped components as described above. In this embodiment, the first three components are fabricated of magnetic material thereby providing an electrode structure having at least two transversely oriented shielding planes. An optional apertured planar magnetic shielding means may be positioned between the third and fourth components.

In another embodiment of the invention, the G3 focusing electrode is basically formed as already described having forward and rear enclosed sections comprised of the four cup-shaped components. In this instance, all four components are fabricated of magnetic material, and the closed portion of the fourth component forms the forwardly oriented apertured shielding plane for the structure, while the closed portions of the second and third components provide additional shielding planes.

In accordance with a further embodiment of the invention, the G3 structure is comprised of two elongated front and rear cup-shaped components, the rear component being fabricated of magnetic material, These two components are positioned in abutting relationship to form an apertured box-like enclosure. An apertured magnetic planar shielding means is positioned intermediate the components. In one aspect of this embodiment, the rear component has a depth less than that of the front component. In another aspect, the rear component has a depth greater than that of the front component.

In a further embodiment of this two-component G3 structure, both cup-shaped components are fabricated of magnetic material. In this instance, the intermediate apertured planar shielding means may be omitted since the closed portion of the front component functions as the forwardly oriented apertured shielding plane for the all magnetic structure.

In a still further embodiment of the invention, the apertures in the associated planar shielding means may be formed, as for example, by coining or extruding to perfect peripheral ridges or standing extensions thereabout to provide additional shielding for the electron beams passing therethrough.

DESCRIPTION OF THE PREFERRED EMBODIMENTS

For a better understanding of the present invention, together with other and further objects, advantages and capabilities thereof, reference is made to the following disclosure and appended claims in conjunction with the accompanying drawings.

Figure 1:
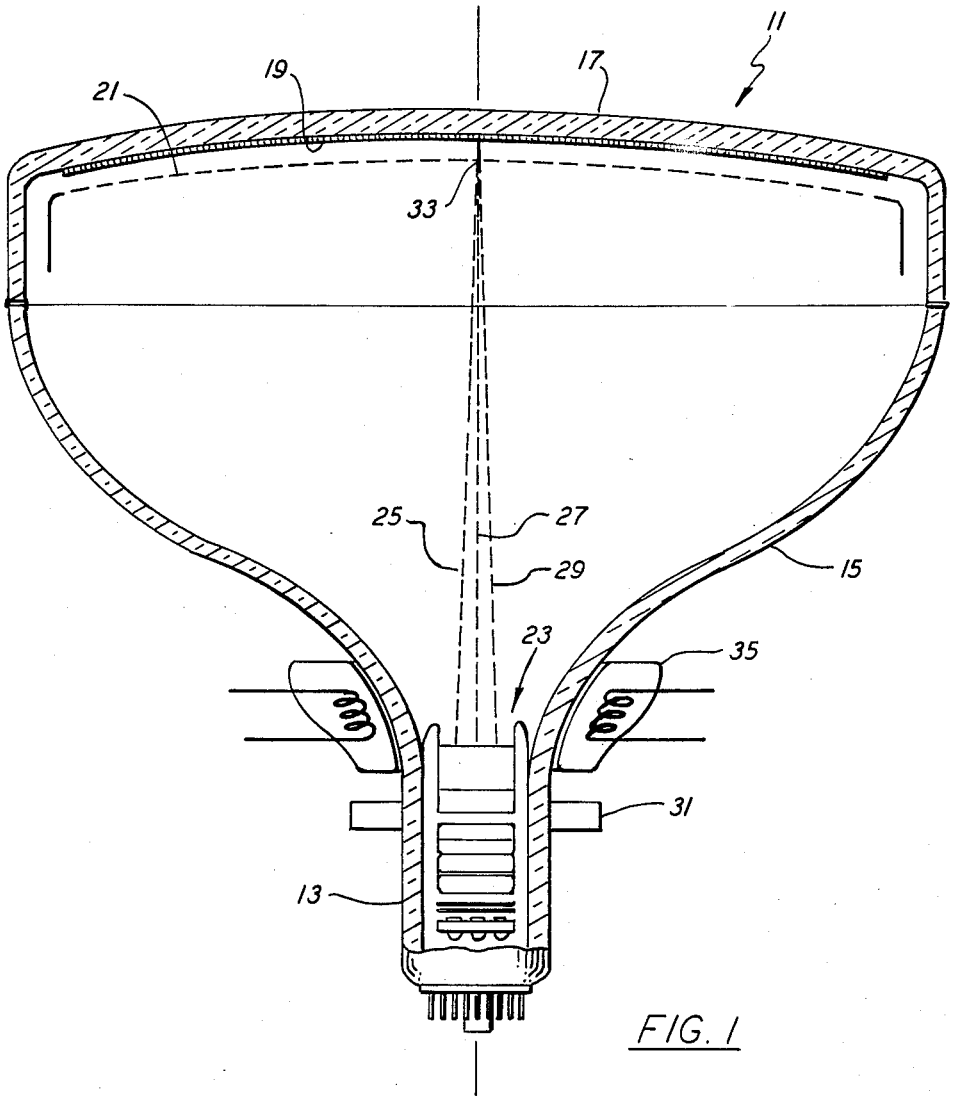
FIG. 1 is a sectioned elevation of an in-line color cathode ray tube wherein the invention is utilized.

With reference to the drawings, there is shown in FIG. 1 a sectioned multibeam in-line CRT 11 having an encompassing envelope comprised of an integration of a neck portion 13, a funnel portion 15 and a face or viewing panel portion 17. A patterned screen 19, including a repetitive plurality of red, green and blue color-emitting phosphor components, is disposed on the interior surface of the viewing panel 17 as a series of definitive stripes or elongated areas. A multi-opening structure 21, such as a shadow-mask, is positioned within the viewing panel, by means not shown, in a manner whereof the multi-opening portion is spatially related to the patterned screen. Positionally encompassed within the neck portion 13 is a multi-beam in-line electron gun assembly 23 which forms and directs three separate in-line electron beams 25, 27, 29 to discretely impinge the screen 19. It is within the focusing electrode structure of this electron gun assembly that the improvement of the invention resides.

Externally positioned on the neck 13, in a manner to encompass a forward region of the gun assembly 23, is a convergence or beam adjustment device 31. This is comprised of a plurality of adjustable magnetic means arranged to impart a controlling field which is essential to effect the desired shifting of the beams within the gun assembly to produce static convergence of the three beams at the plane of the mask 33 in the center of the screen 19. The term "static convergence" refers to the paths followed by the beams when no scanning forces are present. Upon traversing the multi-opening mask, the beams diverge slightly to impinge upon the proper color phosphor depositions of the patterned screen therebeyond.

As the adjusted in-line beams leave the gun assembly under operational conditions, they are controlled by the magnetic fields effected by the coils of a self-converging magnetic deflection yoke 35, such being positioned externally upon the tube envelope at substantially the transitional region between the neck 13 and funnel 15 portions thereof. The magnetic fields produced by the toroidal vertical deflection windings in conjunction with the saddle horizontal deflection windings of the yoke 35, and associated circuitry, cause the three adjusted beams to move or scan, in a converged manner, both horizontally and vertically over the screen to produce three substantially rectangular registered raster patterns on the screen of the tube. It is important that beam convergence be maintained during the scanning process, such is known as "dynamic convergence".

To achieve the desired dynamic convergence, the yoke position is carefully adJusted on the tube neck. Since the yoke produces extensive magnetic back-fields which penetrate the gun assembly precise adjustment of the yoke position becomes a time-consuming and critical procedure. Modifications of the focusing electrode structure in the electron gun assembly have resulted in increased tolerances in yoke positioning while producing better center to edge beam focusing and convergence.

In greater detail, reference is made to FIGS. 2, 3, 4 and 5 wherein one embodiment of the invention is delineated. There is shown an exemplary unitized bi-potential electron gun assembly 23 for effecting the formation and control of each of the respective electron beams 25, 27 and 29 depicted in FIG. 1. Basically, the gun assembly is comprised of a longitudinal arrangement of several functionally related apertured electrode members including, for example, a G1 control or beam forming electrode 37, a G2 initial accelerating electrode 39, a G3 beam focusing electrode 41, and a G4 final accelerator 43, all of which are positioned in a sequential manner forward of rear-oriented electron emitting cathodes 45, 47 and 49. Terminally affixed to the G4 electrode 43 is an in-line apertured convergence cup 51 wherein shunts and/or enhancers may be located in accordance with the known state of the art. These several electrodes comprising the gun assembly are conventionally positioned and held in spaced relationship by a plurality of insulative support rods or multiforms, in this instance, two 53 and 55.

Figure 2:
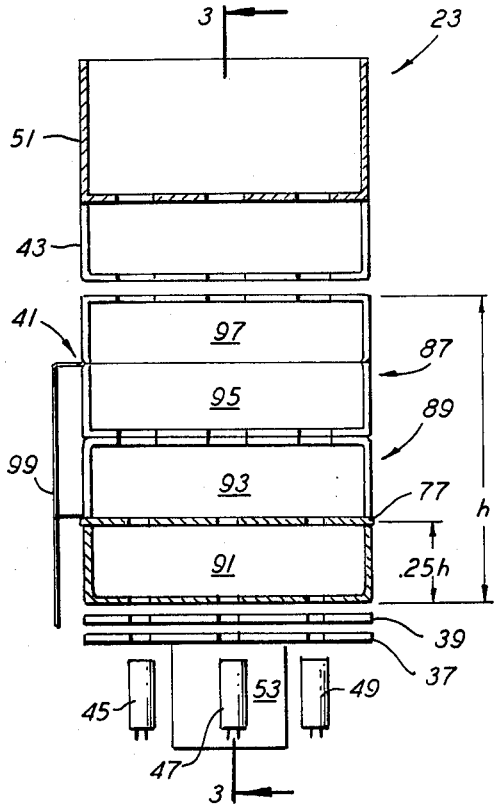
FIG. 2 is an enlarged cross-sectional view of the plural beam in-line electron gun assembly showing one embodiment of the invention incorporated in the focusing electrode thereof.
Figure 3:
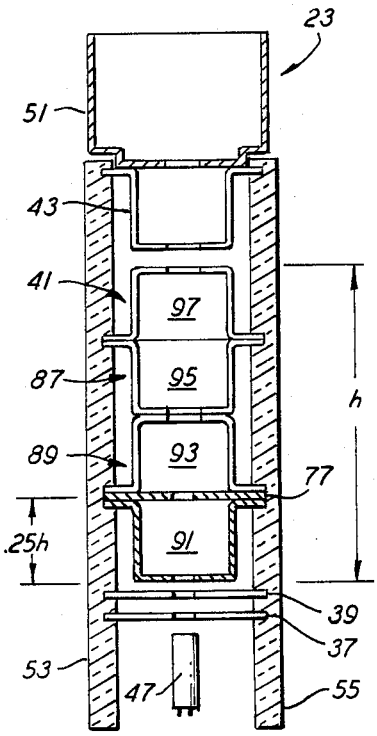
FIG. 3 is an enlarged cross-sectional view of the electron gun assembly taken along the plane 3—3 in FIG. 2.
Figure 4:
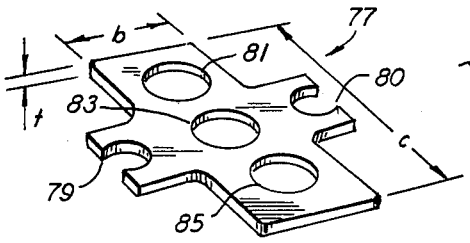
FIG. 4 is an enlarged perspective view of the apertured planar magnetic beam shielding means.
Figure 5:
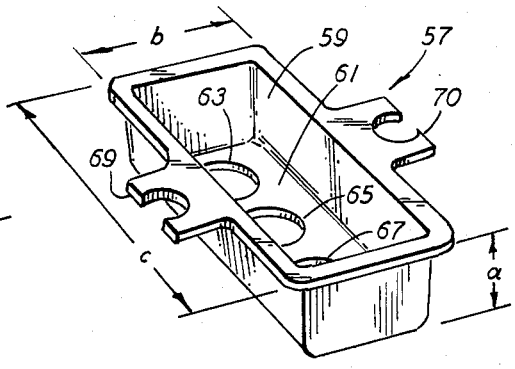
FIG. 5 is an enlarged perspective illustration detailing one of the cup-shaped coaponents comprising the focusing electrode structure in the gun assembly.

The exemplary G3 focusing electrode structure 41, as shown in FIGS. 2 and 3, represents the environment of the invention. Basically, the structure is formed of an integration of a plurality of electrically connected cup-shaped components, such as the example 57 illustrated in FIG. 5. Each such component which evidences a depth "a", a width "b", and an elongated lateral transverse dimension "c", has an open portion 59 and a substantially closed portion 61 with a plurality of in-line apertures 63, 65 and 67 therethrough. An electrode element of this type, often referred to as a "bathtub" component, has outstanding support means, such as configurated ears 69 and 70, formed for embodiment in the multiform supports of the gun assembly.

Figure 10:
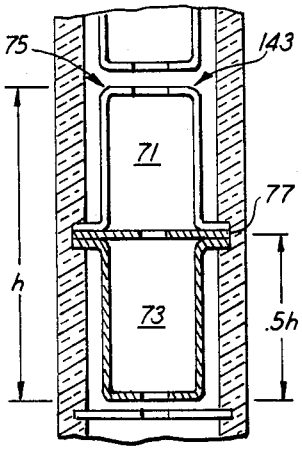

In its most simplistic form, but not necessarily the most preferred embodiment of the inventive concept, a G3 electrode is formed by using at least two of the described cup-shaped components as shown in FIG. 10, wherein front and rear components 71, 73 are joined with their open portions in substantially abutted relationship to form a box-like G3 enclosure 75. It has been found, by fabricating at least one of these components of magnetic material, that beneficial beam shielding effects can be achieved in the G3 structure. As illustrated in FIG. 10, the rear component 73 is magnetic. Furthermore, it has been discovered that markedly beneficial shielding effects are achieved when an associated in-line apertured planar shielding means 77, formed of magnetic material, is positioned in a transverse affixed manner contiguously forward of the magnetic cup component 73. This type of augmentive planar magnetic shielding member 77 is detailed in FIG. 4, wherein the width "b" and length "c" dimensions and the orientation of the configurated ears 79 and 80 are indicated as being similar to those evidenced for the exemplary cup component 57. The member is shown to have a representative thickness "t". The apertures 81, 83 and 85 are of sizes in keeping with the focusing requirements of the electrode structure.

Again, referring to the preferred embodiment of the invention shown in FIGS. 2 and 3, the G3 focusing electrode structure is a multi-element construction comprised of a forward apertured enclosure section 87 and an adjoining rear enclosure section 89. These two enclosures are formed of sequentially oriented first 91, second 93, third 95, and fourth 97 cup-shaped components, such as that delineated in FIG. 5. The forward section 87 is an integration of the third 95 and fourth 97 non-magnetic components joined in abutted relationship and affixed by the respective positioning ears to the multiforms 53, 55. The rear enclosure section 89 is formed of the first component 91, fabricated of magnetic material, and the second component 93 made of non-magnetic material with the apertured planar magnetic shielding means 77 affixed therebetween. This enclosure is likewise attached to the multiforms as shown. The four components comprising this electrode structure have accumulative depths, which in conjunction with the thickness "t" of the planar magnetic shielding means 77, achieves the required over-all length "h" of the G3 electrode. The two box-like enclosures comprising the G3 electrode are electrically connected by means such as connector 99.

In this preferred embodiment, at least one fourth (0.25 h) of the electrode structure is of magnetic material. Since the structure employs a plurality of similar cup-shaped elements, it is evident that the magnetic shielding properties of the electrode ca be varied as beam shielding requirements dictate by substituting magnetic components for non-magnetic ones. Thus, the multi-component structure represents advantageous versatility and cost effectiveness.

Other preferred embodiments of the multi-component G3 electrode are illustrated in FIGS. 6 through 9, each view of which is taken along the gun plane as shown in FIG. 3.

Figure 6:
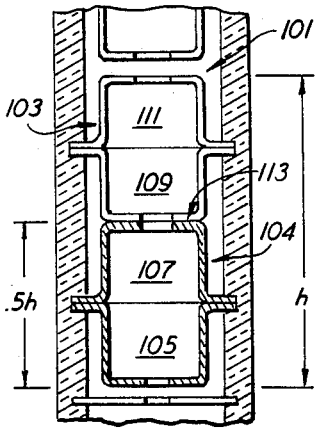
FIGS. 6, 7, 8, 9 and 10 are sectioned views showing various embodiments of the invention.
Figure 7:
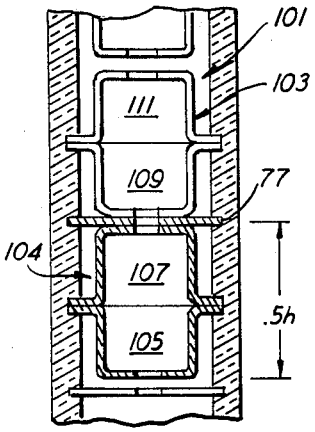

With reference to FIGS. 6 and 7, the G3 electrode structure 101 is made up of front and rear box-like apertured enclosures 103, 104, The rear enclosure 104 is an integration of first and second 105, 107 cup-shaped components, both of which are fabricated of magnetic material; while the forward enclosure 103 is formed of non-magnetic components 109 and 111. As indicated, the apertured closed portion 113 of the magnetic second component 107 forms the forwardly oriented apertured magnetic shielding plane for the electrode. In this embodiment, at least substantially one-half (0.5h) of the electrode structure 101 is of magnetic material. If a greater transverse mass of beam shielding material is required for efficiency in this electrode embodiment or if a spacer is needed to achieve the optimum length dimension for the electrode, a separate in-line apertured planar magnetic shielding means 77 is inserted and affixed between the second 107 and third 109 components. If the magnetic characteristics of the FIG. 6 embodiment are optimum for requirements but additional length is required for the electrode structure, an apertured non-magnetic planar spacer may be inserted between the second 107 and third 109 components, in a manner similar to that shown in FIG. 7, without disturbing the magnetic properties of the structure.

Figure 8:
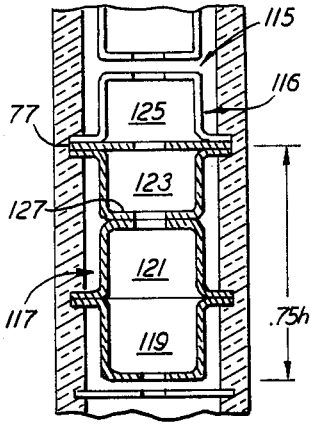

A further embodiment of the invention is detailed in FIG. 8, wherein the G3 electrode 115 is comprised of forward 116 and rear 117 enclosure sections. The rear enclosure is an integration of first 119 and second 121 components of which both are of magnetic material. In the adjoining forward enclosure section, the third component 123 is also fabricated of magnetic material, while the fourth component 125 is formed of non-magnetic metal. Inserted between these components and joined therewith is the planar shielding means 77 forming the forward oriented apertured magnetic shield for the structure. In this construction, the magnetic material comprises at least substantially three-fourths (0.75h) of the electrode structure. If it is found that a lesser degree of beam shielding is sufficient to meet the requirements, the apertured planar member 77 can be omitted from the structure, in which case, the closed portion 127 of the third magnetic component 123 becomes the forwardly oriented shielding plane.

Figure 9:
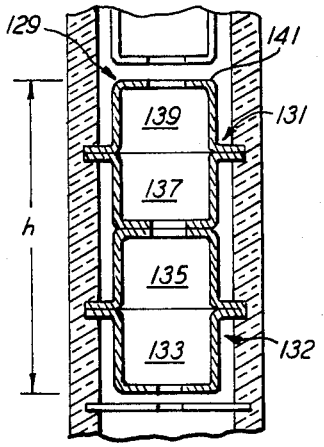

The G3 electrode 129 embodiment illustrated in FIG. 9 is likewise made up of forward enclosure section 131 and a rear section 132. In this instance, the first 133, second 135, third 137, and fourth 139 components, making up both the forward 131 and rear sections 132, are all fabricated of magnetic material. Thus, the complete electrode structure is comprised of magnetic material whereof the closed portion 141 of the fourth component 139 forms the forwardly oriented apertured shielding plane for the electrode structure.

While the embodiment of the invention shown in FIG. 10 has been previously described herein, it is evident that further beneficial modifications thereof can be effected.. For example, while still maintaining the electrode length "h", the two cup-shaped components 71 and 73 can be fabricated to have differing but conjunctive depths. When the rear magnetic component 73 has a depth less than that of the front component 71, the magnetic portion of the electrode constitutes less than half of the G3 structure. Similarly, when the rear component is fabricated to have a depth greater than that of the front component, the magnetic portion of the electrode is greater than half of the structure. In each instance, the forwardly oriented apertured magnetic beam shielding plane 77 is affixed as an intermediate insert in the jointure of the two components.

By fabricating both of the front 71 and rear 73 components of the G3 electrode 75 in FIG. 10 of magnetic material, the intermediate magnetic shielding member 77 can be eliminated. In this instance, the closed portion 143 of the front component 71 forms the forwardly oriented aperture shielding plane for the all magnetic electrode structure.

Figure 11:
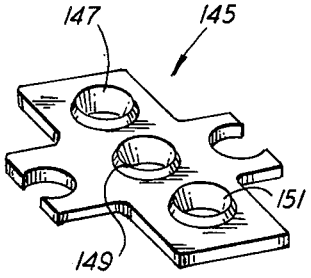
FIG. 11 is an enlarged perspective illustration showing an embodiment detailing peripheral extensions of the apertures in the planar magnetic shielding means.

With reference to FIG. 11, there is shown a modification of the magnetic planar shielding means 145 wherein the apertures are formed, as by coining or extrusion, to provide peripheral standing extensions 147, 149 and 151 to effect additional shielding for the electron beams passing therethrough. This magnetic shielding plane may be substituted for the planar shielding member 77 when augmentive shielding is required.

The non-magnetic material used in fabricating the cup-shaped components of the G3 electrode structure is a non-magnetic stainless steel, such as Type 305 S.S., an alloy material commonly used in the fabrication of gun parts.

The magnetic material suitable for the fabrication of the magnetic components is a magnetically soft material exhibiting high permeability, such as for example a nickel-iron alloy wherein the nickel content is in the range of 40 to 60 percent. Such material is annealed, for example, in the vicinity of 1100° C. for a time period required to reduce the carbon, sulfur and oxygen contents. Examples of suitable alloys are 52% Alloy and Permalloy 49, both of which are known and commonly used in the electronics industry.

The invention provides markedly improved beam shielding within the G3 focusing electrode structure. The multi-component construction enables expeditious variation of the magnetic shielding properties of the electrode in accordance with the requirements. The cooperation of the magnetic portions of the structure effects beneficial shielding of the beams from the influences of the backfield of the yoke, thereby reducing the criticality of yoke positioning.

While there have been shown and described what are at present considered the preferred embodiments of the invention, it will be obvious to those skilled in the art that various changes and modifications may be made therein without departing from the scope of the invention as defined in the appended claims.

We claim:

1. In a plural beam in-line color cathode ray tube, an electron gun assembly comprising a plurality of electrodes positioned sequentially forward of rear-oriented electron emitting cathodes, said electrodes including a focusing electrode, a final accelerating electrode positioned forward of the focusing electrode, and a convergence cup positioned forward of the final accelerating electrode, the focusing electrode structure having a focus voltage and having forward and rear plural apertured portions, said focusing electrode structure being formed of an integration of a plurality of electrically connected cup-shaped components having depth and elongated lateral transverse dimensions, each of said components having an open portion and a substantially closed portion with a plurality of in-line apertures therethrough, at least two of said components being positioned with their open portions in abutted relationship to form a box-like enclosure, said focusing electrode structure incorporating beam shielding means comprising:

at least one in-line apertured planar shielding formed of magnetic material and oriented transverse to the beam path forward of said rear apertured portion for shielding the electron beams from the influence of the backfield of an externally positioned magnetic deflection yoke.

2. The cathode ray tube in-line focusing electrode structure according to claim 1 wherein at least one of said cup-shaped components is formed of magnetic material.

3. The cathode ray tube in-line focusing electrode structure according to claim 1 wherein said structure is comprised of forward and rear adjoining enclosed sections, formed of sequentially oriented first, second, third and fourth cup-shaped components, said forward section being formed of said third and fourth components, and said rear-section being formed of said first and second components, with said apertured magnetic planar shielding means affixed between said forward and rear portions.

4. The cathode ray tube in-line focusing electrode structure of claim 3 wherein said first component is fabricated of a magnetic material.

5. The cathode ray tube in-line focusing electrode structure according to claim 2 wherein said cup-shaped components exhibit depth dimensions to provide at least substantially one-fourth of said electrode structure to be of magnetic material with a contiguous apertured magnetic shielding plane forward thereof.

6. The cathode ray tube in-line focusing electrode structure according to claim 1 wherein said structure is comprised of forward and rear adjoining enclosed sections, formed of sequentially oriented first, second, third and fourth cup-shaped coxponents, said forward section being formed of said third and fourth coxponents, and said rear section being formed of said first and second components, said first and second components being fabricated of magnetic material, the closed portion of said second component forming the forwardly oriented apertured magnetic shielding plane for said structure.

7. The cathode ray tube in-line focusing electrode structure according to claim 6 wherein said cup-shaped components exhibit depth dimensions to provide at least substantially one-half of said electrode structure to be of magnetic material evidencing a forwardly oriented apertured magnetic shielding plane.

8. The cathode ray tube in-line focusing electrode structure according to claim 6 wherein a separate in-line apertured planar shielding means of magnetic material is positioned transversely between said second and third cup-shaped components.

9. The cathode ray tube in-line focusing electrode structure according to claim 1 wherein said structure is comprised of forward and rear adjoining enclosed sections formed of sequentially oriented first, second, third and fourth cup-shaped components, said rear section being formed of said first and second components, and said forward section being formed of said third and fourth components, the first, second and third components being fabricated of magnetic material, the closed portions of said second and third magnetic components forming forwardly oriented apertured magnetic shielding planes for said structure.

10. The cathode ray tube in-line focusing electrode structure according to claim 9 wherein a forward oriented apertured shielding means of magnetic material is positioned between said third and fourth cup-like components.

11. The cathode ray tube in-line focusing electrode structure according to claim 9 wherein said cup-shaped components exhibit depth dimensions to provide at least substantially three-fourths of said electrode structure to be of magnetic material with a contiguous apertured magnetic shielding plane forward thereof.

12. The cathode ray tube in-line focusing electrode structure according to claim 1 wherein said structure is comprised of forward and rear adjoining enclosed sections formed of sequentially oriented first, second, third and fourth components fabricated of magnetic material; said rear section being formed of said first and second components, and said forward section being formed of said third and fourth components, the closed portions of said second, third and fourth components forming forwardly oriented apertured shielding planes, thereby effecting a complete electrode structure of magnetic material.

13. The cathode ray tube in-line focusing electrode structure according to claim 1 wherein said structure is comprised of two front and rear cup-shaped components positioned in abutting relationship to effect an apertured box-like enclosure, whereof said rear component is fabricated of magnetic material, and wherein said apertured magnetic planar shielding means is positioned intermediate said components.

14. The cathode ray tube in-line focusing electrode structure according to claim 13 wherein said rear component has a depth less than that of said front component, whereby the magnetic portion of said structure is less than half thereof.

15. The cathode ray tube in-line focusing electrode structure according to claim 13 wherein said rear component has a depth greater than that of said front component whereby the magnetic portion of said structure is greater than half thereof.

16. The cathode ray tube in-line focusing electrode structure according to claim 1 wherein said structure is comprised of an integration of front and rear cup-shaped components fabricated of magnetic material, and wherein said closed portion of said front component form a forwardly oriented apertured shielding plane, thereby effecting a complete electrode structure of magnetic material.

17. The cathode ray tube in-line focusing electrode structure according to claim 1 wherein the apertures of said magnetic planar shielding means are formed to have peripheral standing extensions to provide additional shielding for the electron beams passing therethrough.

* * * * *